US005399105A

United States Patent [19]

Kaufman et al.

[11] Patent Number: 5,399,105

[45] Date of Patent: Mar. 21, 1995

[54] CONDUCTIVE SHROUD FOR ELECTRICAL CONNECTORS

[75] Inventors: John W. Kaufman, Hershey; John A. Root, Middletown; James L. Schroeder, Palmyra, all of Pa.

[73] Assignee: The Whitaker Corporation, Wilmington, Del.

[21] Appl. No.: 235,617

[22] Filed: Apr. 29, 1994

[51] Int. Cl.[6] ..... H01R 13/658

[52] U.S. Cl. ..... 439/609; 439/108

[58] Field of Search ..... 439/607, 609, 101, 108, 439/608, 610, 79

[56] References Cited

U.S. PATENT DOCUMENTS

| | | | |
|---|---|---|---|
| 3,775,643 | 11/1973 | Schachnow et al. | 361/759 |
| 3,932,016 | 1/1976 | Ammenheuser | 439/377 |
| 4,046,443 | 9/1977 | Champagne | 439/377 |
| 4,583,807 | 4/1986 | Kaufman et al. | 439/83 |
| 4,623,211 | 11/1986 | Dambach et al. | 439/607 |
| 4,732,365 | 3/1988 | Kloster | 254/10.5 |
| 4,756,696 | 7/1988 | Whiteman, Jr. | 439/79 |
| 4,846,727 | 7/1989 | Glover et al. | 439/608 |
| 4,861,277 | 8/1989 | Bina | 439/377 |
| 4,941,841 | 7/1990 | Darden et al. | 439/377 |
| 4,952,161 | 8/1990 | Komatsu | 439/155 |
| 4,992,052 | 2/1991 | Verhoeven | 439/62 |
| 5,035,631 | 7/1991 | Piorunneck et al. | 439/108 |
| 5,040,999 | 8/1991 | Collier | 439/108 |
| 5,051,101 | 9/1991 | Komatsu | 439/159 |
| 5,195,899 | 3/1993 | Yatsu et al. | 439/101 |
| 5,288,247 | 2/1994 | Kaufman | 439/607 |

OTHER PUBLICATIONS

Memory/PC Card Connector (Compatible with PCMCIA, Release 2.0); AMP Incorporated; Dec. 1991.

PC Card Standard, Release 2.0, Personal Computer Memory Card International Association (PCMCIA); Sep. 1991.

InterConnection Technology, IHS Group Publication; *Surface Mount Connector Hold Downs;* Aug. 1992.

Technical Paper; AMP; *Surface Mount Connector Hold Downs;* By: Henry B. Collins and Tim Kocher; Copyright 1991, by AMP Incorporated.

*Primary Examiner*—Gary F. Paumen

[57] ABSTRACT

A connector array (10) for mounting to a circuit board is disclosed including a conductive shroud (16) and two electrical connectors (12, 14). The shroud includes a conductive first plate (60) that separates the two connectors (12, 14) and the leads (34) of one connector from the leads (38) of the other connector. The shroud includes solder tails (68) that electrically engage ground circuitry on the circuit board (18). A conductive second plate (64) is spaced from and parallel to the first plate (60). Contacts (72, 80) extend from edges of each of the first and second plates and are arranged so that when memory cards (28, 30) are mated with the two connectors the contacts electrically engage outer conductive surfaces of the two memory cards. The two connectors are secured in a vertically stacked position by means of a pair of clips (50) that are in interfering engagement with openings (52) formed in outer walls of the housings of the two connectors.

14 Claims, 6 Drawing Sheets

CONDUCTIVE SHROUD FOR ELECTRICAL CONNECTORS

The present invention relates to conductive shrouds used to provide a ground reference with respect to signal carrying pins in electrical connectors associated with the shroud.

BACKGROUND OF THE INVENTION

In an effort to standardize the interface of electronic equipment, in certain cases, the industry has established pin assignments for the connectors utilized in the interface. An example is a 68 pin connector utilized for interconnecting to memory cards in various computer applications. This connector has 60 signal pins, 4 ground return pins, and 4 DC voltage pins, all of which are preassigned by the industry. The signal to ground ratio of an electrical connector is equal to the number of signal carrying pins divided by the number of ground return pins in the connector. Since the DC voltage pins, for purposes of the present disclosure, can be considered similar in effect to the AC voltage ground pins, the signal to ground ratio of this 68 pin connector is 7.5 to 1.0. In computer applications, typically, multiple lines are simultaneously switched and all return current generated by this switching must be returned through one of the ground pins. Therefore, the return current of 8 or so signal pins must be accommodated by a single ground pin. This is no problem when the signal rise time is relatively slow, in the 8 to 10 nanosecond range. However, when the rise time is increased, as in certain computer applications, the induced voltage is increased resulting in "ground bounce" or common mode noise in the ground return pins. When ground bounce reaches a high enough level, relative to the level of the signals, the systems may become unable to reliably read and respond to the signals thereby causing what is known in the industry as "false triggering". Since the pin assignments have been fixed by the industry, the signal to ground ratio cannot be altered. However, to reduce the adverse effects of the faster rise times, a conductive shroud may be utilized that electrically interconnects the ground of the memory card to the ground of the equipment with which the card is being used. Such a shroud and related connector are disclosed in U.S. Pat. No. 5,288,247 which issued Feb. 22, 1994 to Kaufman and which is incorporated herein by reference. The shroud of the '247 patent is arranged to enclose the top of the connector and the two sides thereof. Several contacts extend from the shroud and electrically engage a conductive outer surface on a memory card that is mated with the connector. The shroud is electrically connected to ground circuitry on the circuit board and results in greatly improved performance of the equipment. In some equipment it is desirable to utilize more than one memory card, but the additional memory card connectors require significant circuit board space, which may not be available. Therefore, what is needed is a shroud that will accept multiple connectors in a vertically stacked relationship that benefit from the improved performance of the single connector shroud.

SUMMARY OF THE INVENTION

A conductive ground plane shroud is disclosed for use with a plurality of electrical connectors, each having a set of signal carrying pins for electrically engaging circuitry on a circuit board. The shroud is arranged for electrically engaging ground circuitry on the circuit board for providing a ground reference with respect to the pins. Each connector is arranged to receive and electrical couple to an electrical module. The shroud includes an electrically conductive layer separating adjacent connectors and their respective sets of signal carrying pins, and contacts extending therefrom for engaging an outer surface of each of the electrical modules when the module is mated with one of the plurality of electrical connector.

DESCRIPTION OF THE PREFERRED EMBODIMENT

Figure 1:
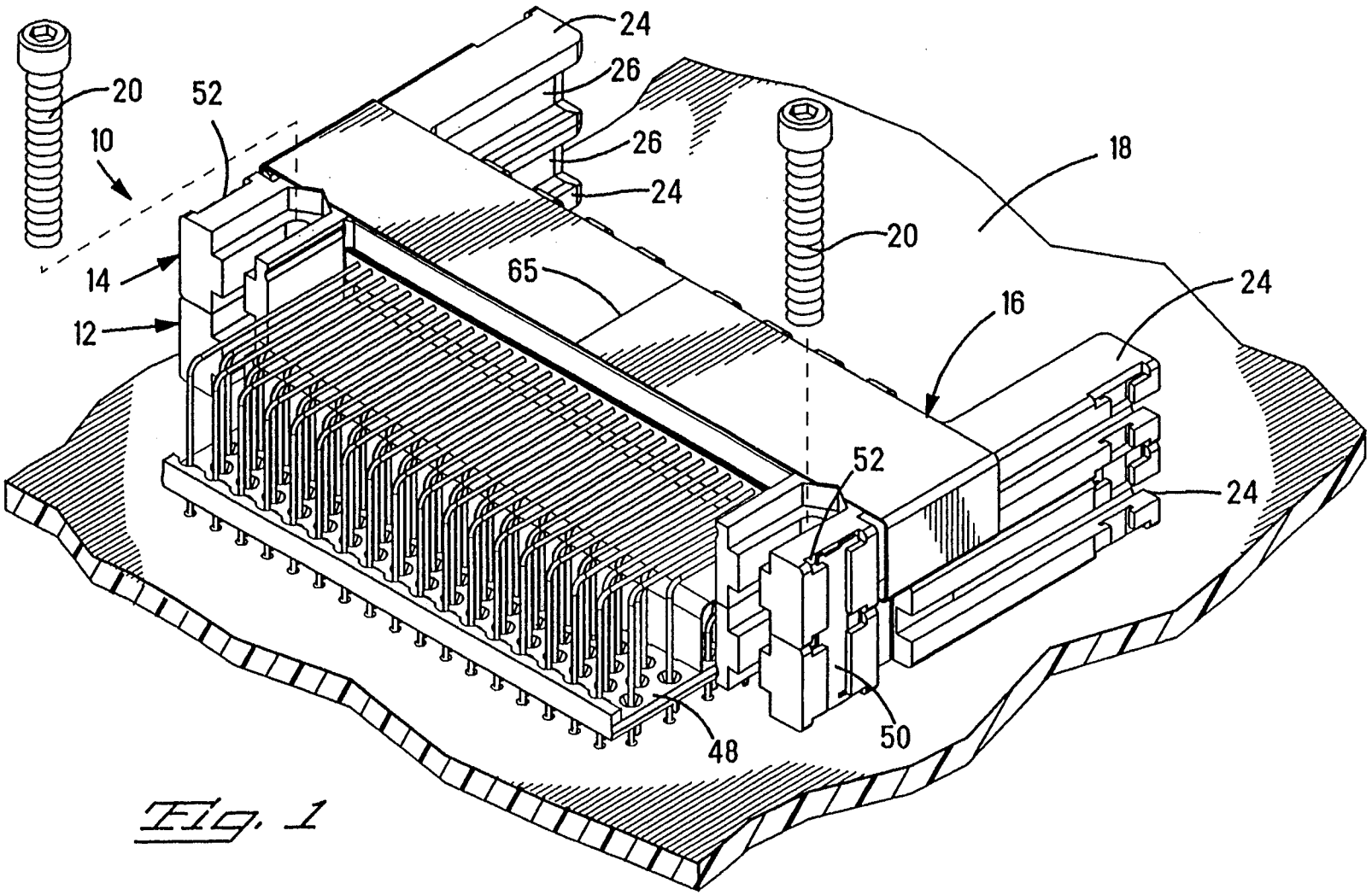
FIG. 1 is an isometric view of a two connector array and shroud incorporating the teachings of the present invention.
Figure 2:
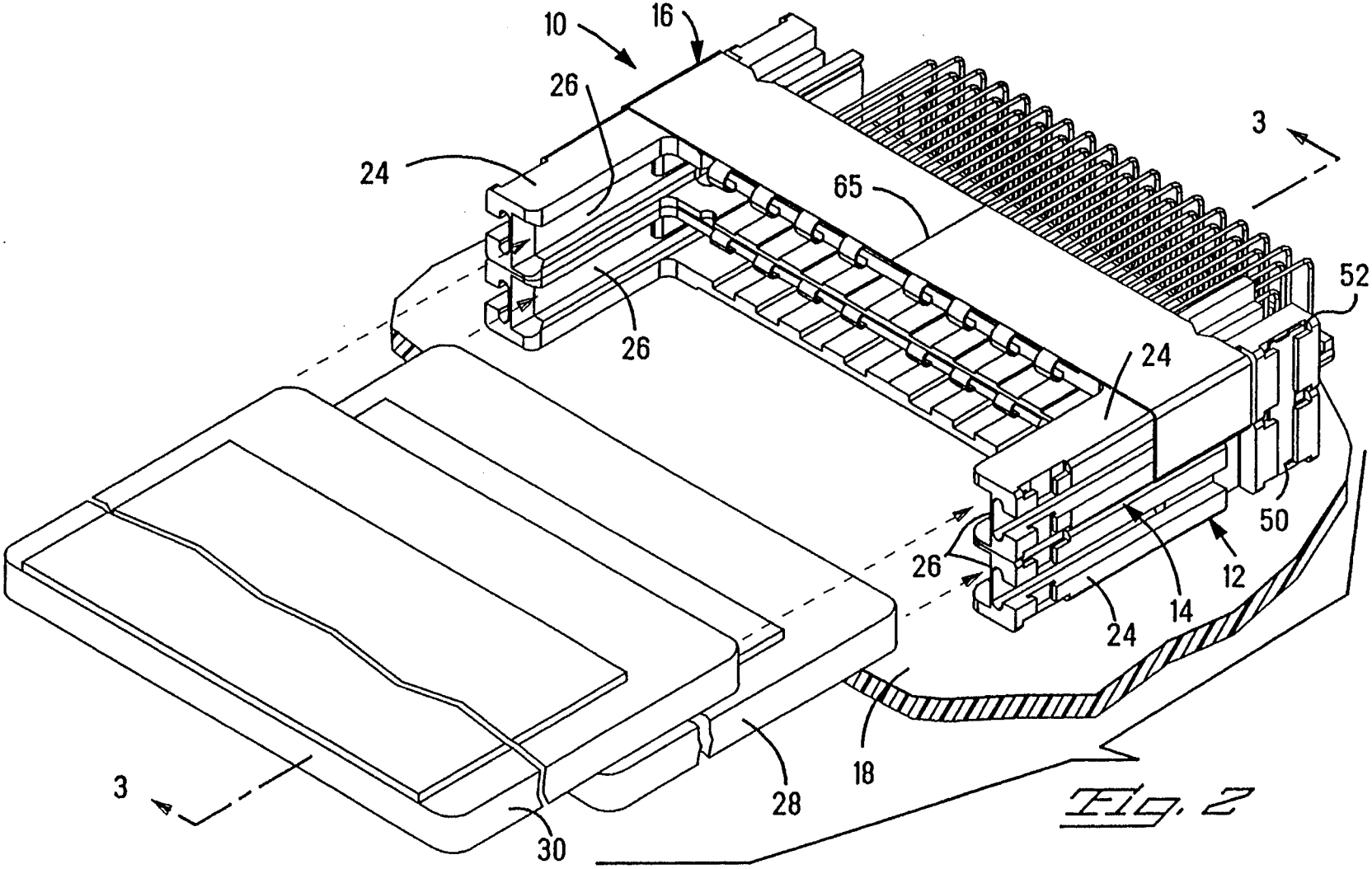
FIG. 2 is an isometric view of the connector array of FIG. 1, rotated 180 degrees, showing two memory cards about to be inserted.
Figure 3:
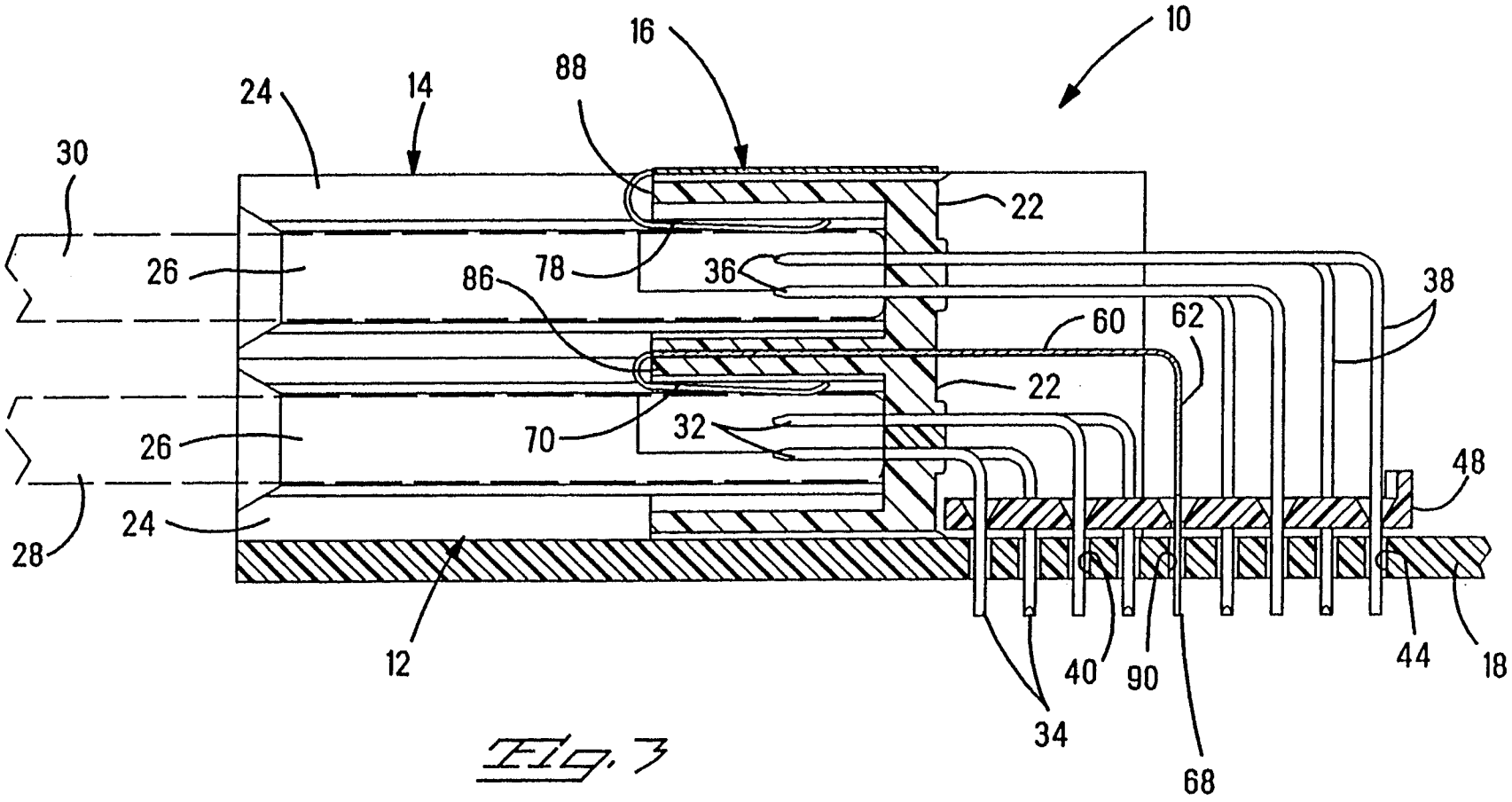
FIG. 3 is a cross-sectional view taken along the lines 3—3 in FIG. 2.
Figure 8:
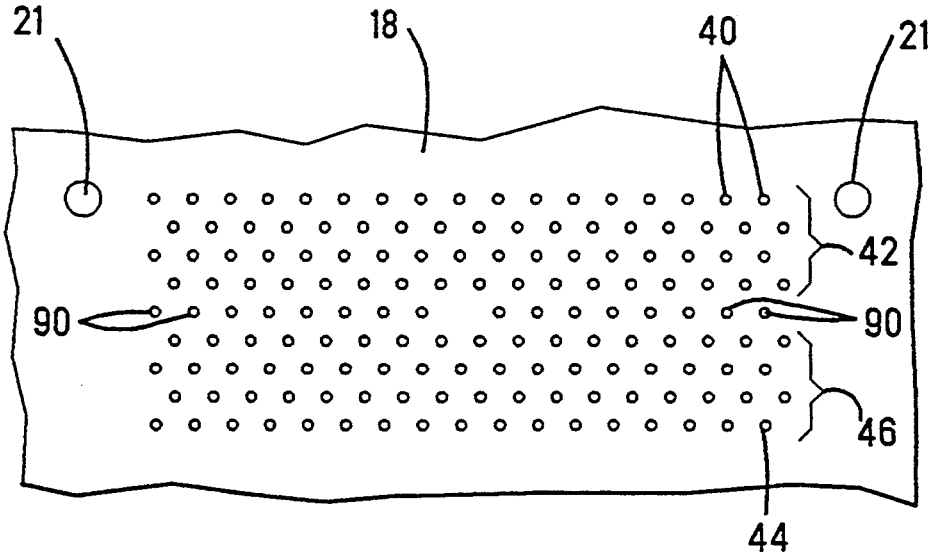
FIG. 8 is a hole pattern layout in a circuit board for the connector array shown in FIG. 1.

There is shown in FIGS. 1, 2, and 3 a two connector array 10 with shroud. The array 10 includes first and second memory card connectors 12 and 14 arranged in vertically stacked relationship and a conductive shroud 16. The array 10 is attached to a circuit board 18 by means of two screws 20 that extend through holes 21 in the circuit board (shown in FIG. 8) and into nuts, not shown, positioned on the other side of the board. Each connector 12 and 14 includes an insulating housing 22 with extended side arms 24 having guide slots 26. First and second memory cards 28 and 30, as best seen in FIG. 2, are arranged to slide into the guide slots 26 and mate with their respective connectors 12 and 14. As best seen in FIG. 3, the connector 12 includes a plurality of electrical contacts 32 that project through the housing 22 and terminate in downwardly extending tails 34 that extend through holes in the circuit board 18 in electrical engagement with circuitry on the circuit board. Similarly, the connector 14 includes a plurality of electrical contacts 36 that project through the housing 22 and terminate in downwardly extending tails 38 that extend through other openings in the circuit board 18 in electrical engagement with circuitry thereon. Note that all of the tails 34 of the connector 12 are arranged so that they extend through holes 40 through the circuit board 18 that are arranged in four parallel rows 42, while all of the tails 38 are arranged so that they extend through holes 44 that are arranged in four parallel rows 46, as shown in FIG. 8. A standard plastic lead organizer 48 having through holes in the same pattern as the holes 40 and 44 is shown in place in FIGS. 1 and 3 and aids in the assembly of the array 10 to the circuit board 18 in the usual manner. Prior to assembly to the circuit board 18, the connector array 10 is held together by means of a pair of elongated clips 50 which extend through a pair of aligned slots 52 formed in outer edges of the two housings 22, as best seen in FIG. 1. The two elongated clips 50 are in interfering fit with their respective slots 52 so that the two connectors are firmly secured together. An alternative method of securing the array 10 to the circuit board 18, instead of the screws 20, is a barbed end, not shown, on the elongated clips 50 that interferingly extends into suitably positioned holes in the circuit board. Each of the connectors 12 and 14 are substantially similar to the single connector disclosed in the above referenced '247 patent to which reference should be made for a more detailed discussion of that connector.

As shown in FIGS. 4, 5, 6, and 7, the shroud 16 includes a substantially flat first plate 60 having a bent down portion 62, a second plate 64 that is spaced from and parallel to the first plate 60, and side plates 66 and 67. Several solder tails or leads 68 extend downwardly from the bent down portion 62 for interconnection with ground circuitry on the circuit board 18. The tails 68 are spaced to correspond to the spacing of and sized to slip into a series of holes 90 formed through the circuit board 18 between the two groups of rows 42 and 46, as shown in FIG. 8. A group of first contact arms 70, having contacts 72 adjacent their free ends, extend outwardly from a first edge 74 of the shroud, undergo a bend at 76 that is greater than 90 degrees but less than 180 degrees, in the present example the bend is approximately 172 degrees, so that the contacts 72 are positioned under the first plate 60, as viewed in FIG. 6. Similarly, a group of second contact arms 78, having contacts 80 adjacent their free ends, extending outwardly from a second edge 82, undergo a bend at 84 that is greater than 90 degrees and less than 180 degrees, so that the contacts 80 are positioned under the second plate, as viewed in FIG. 6.

Figure 6:
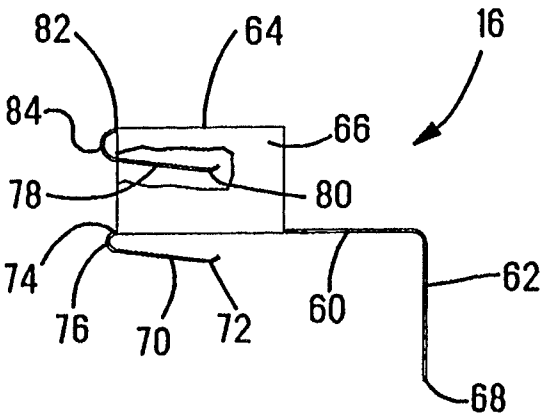
FIGS. 4, 5, and 6 are front, top, and side views, respectively, of the shroud shown in FIG. 1.
Figure 5:
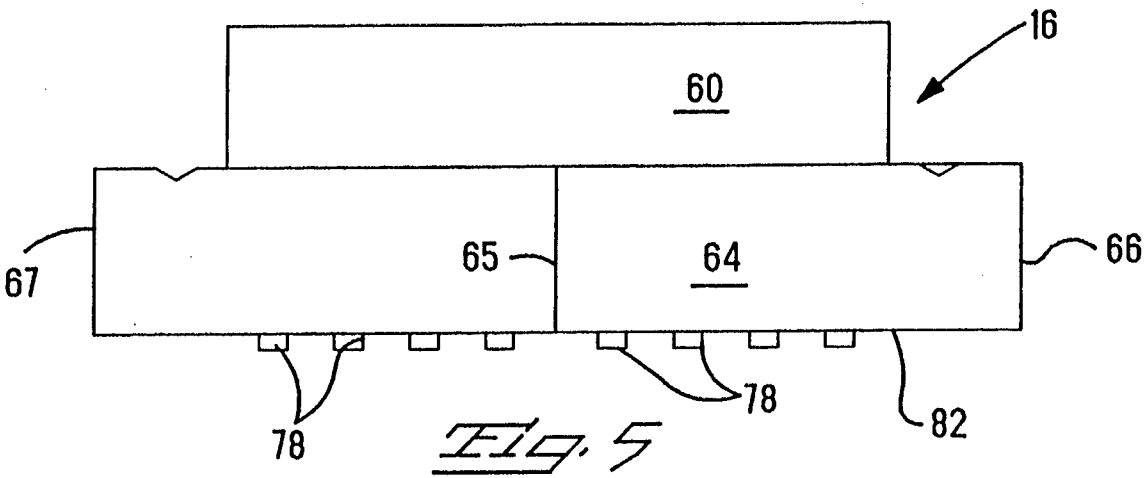
Figure 4:
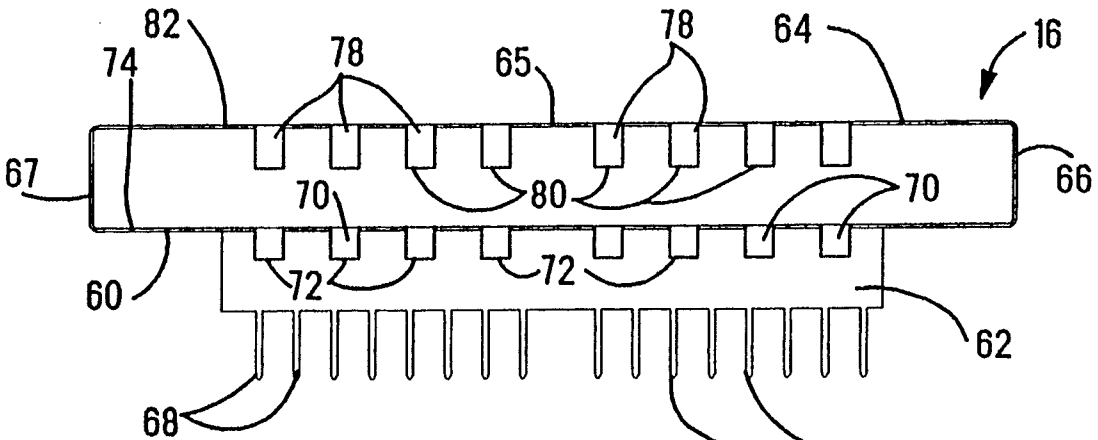
Figure 7:
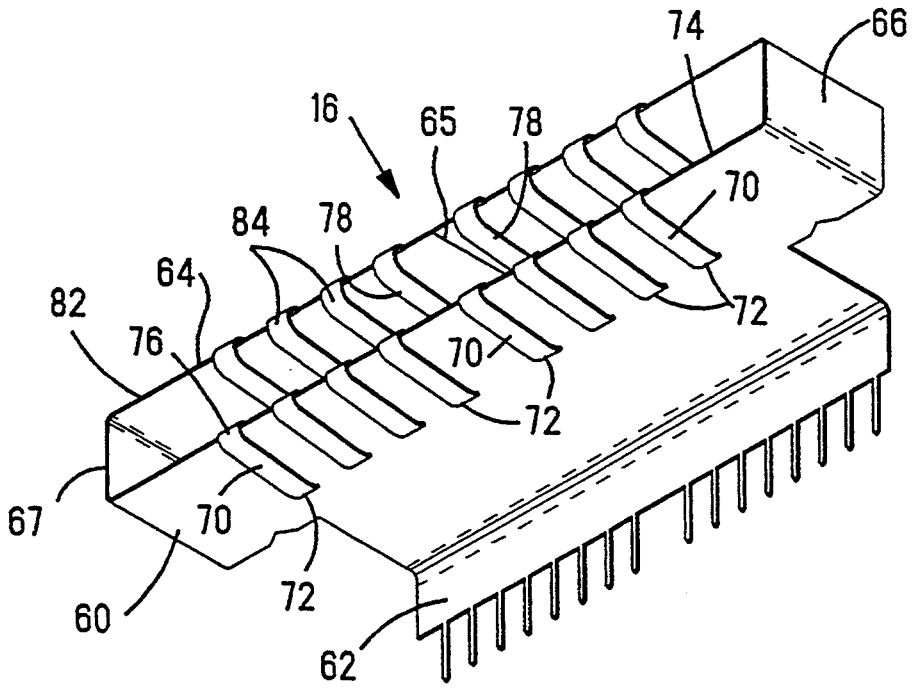
FIG. 7 is an isometric view of the shroud shown in FIG. 4.

The shroud 16 is manufactured by stamping from flat sheet stock and forming into the structure shown in FIGS. 4, 5, and 6, in the usual manner. In forming the second plate 64, the sides 66 and 67 are folded upwardly from the ends of the first plate 60 and then folded toward each other and terminated in a joint 65, as best seen in FIG. 5. The joint 65 may be welded or brazed, as desired, to form a rigid structure that will not deflect appreciably under the forces of the contact arms 78 when the memory card 33 is in mated engagement with the connector 14. Alternatively, the joint 65 may be made by forming an offset, now shown, in one of the joining ends of the second plate 64 and arranging an overlap with the other end, the overlapped portions being spot welded together.

Figure 9:
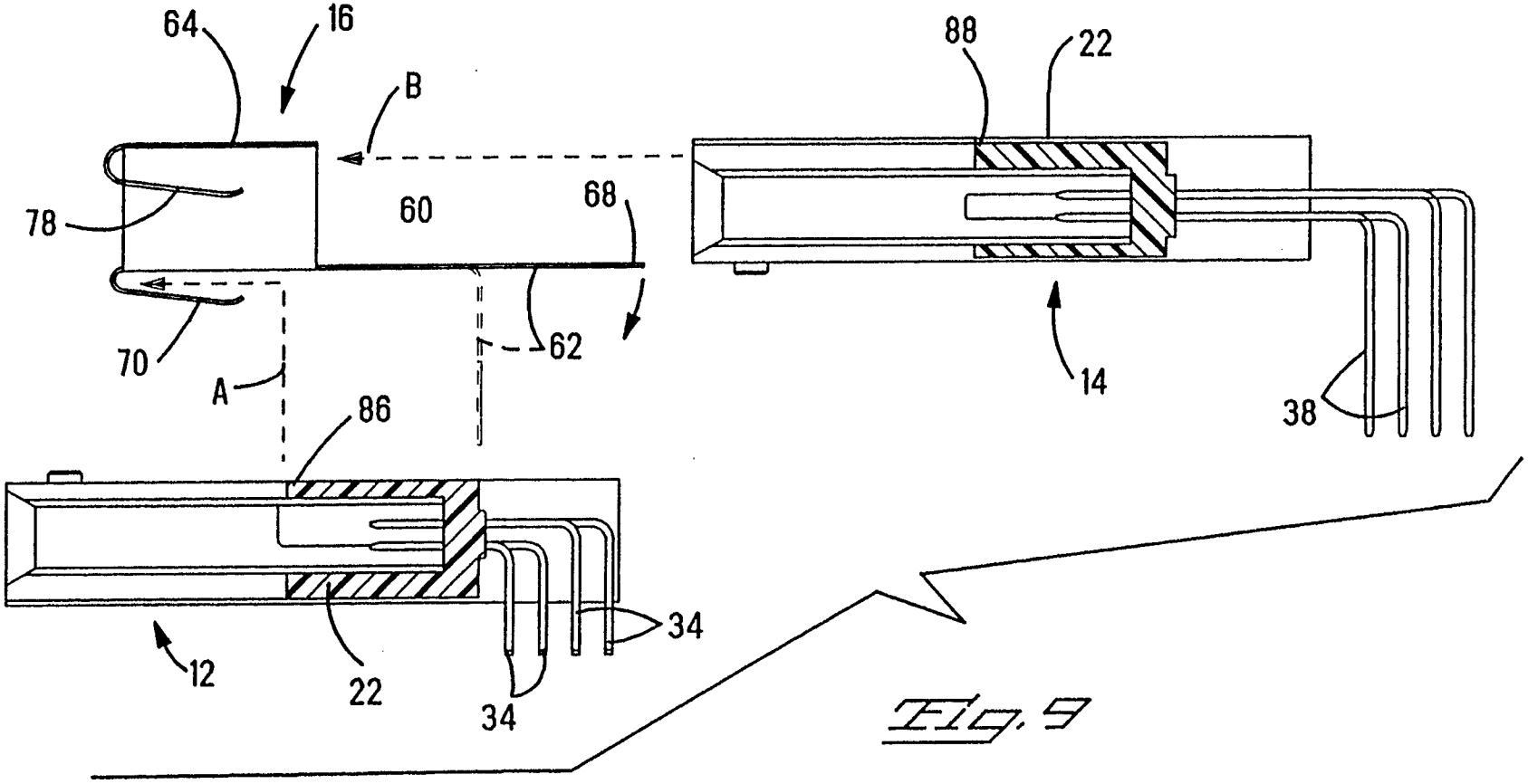
FIG. 9 is a cross-sectional view of the shroud and two connectors showing their assembly.

As best seen in FIG. 9, the connector 12 is assembled to the shroud 16 by moving the connector in the direction of arrow A so that the upper edge 86 of the connector housing 22 is inserted between the contact arms 70 and the plate 60. The portion 62 is then bent downwardly to the position shown in phantom lines in FIG. 9. With the top of the connector housing 22 in engagement with the plate 60 and the upper edge 86 fully forward with respect to the shroud 16 to the position shown in FIG. 3, the connector 14 is then moved leftwardly, as indicated by the arrow B shown in FIG. 9, so that its upper edge 88 is inserted between the contact arms 78 and the plate 64. The connector 14 is moved to its left most position with respect to the shroud to the position shown in FIG. 3. The clips 50 are then inserted into the slots 52 to secure the two connectors 12 and 14 and the shroud 16 together as an assembly. The lead organizer 48 is then attached to the assembly so that the leads 34, 38 and 68 extend through their respective holes in the lead organizer in the usual manner. The connector array 10 is then mated to the circuit board so that the leads 34, 38, and 68 engage their respective plated through holes 40, 42 and 90 in the circuit board 18, as shown in FIG. 3, and the leads are soldered in place in the usual manner.

Note that the conductive plate 60 and its downwardly bent portion 62 completely separate the two connectors 12 and 14 and their respective sets of leads 34 and 38. This provides a significant amount of electrical isolation between signals carried by the two connectors. Since the contact arms 70 and 78 electrically engage a grounding surface on each of the memory cards 28 and 30 and the tails 68 electrically engage ground circuitry on the circuit board 18, the inductance in the ground pins is substantially reduced, especially in the rows of pins closest to the plates 60 and 64, thereby reducing ground bounce in these rows of pins and reducing the possibility of false triggering.

An important advantage of the present invention is that the present shroud will accept multiple connectors in a vertically stacked relationship thereby utilizing less space on the circuit board than would otherwise be necessary. Additionally, the shroud provides superior performance by significantly reducing ground bounce in both connectors while providing individual parts that are easily assembled into a stacked connector array that also is easily assembled to a circuit board.

We claim:

1. A conductive ground plane shroud for use with a plurality of electrical connectors, each connector having a set of signal carrying pins for electrically engaging circuitry on a circuit board, said shroud arranged for electrically engaging ground circuitry on said circuit board for providing a ground reference with respect to said pins, each said connector arranged to receive and electrical couple to an electrical module, said shroud comprising:

(a) an electrically conductive layer separating adjacent said connectors and their respective sets of signal carrying pins; and (b) contacts extending therefrom for engaging an outer surface of each of said electrical modules when said electrical modules are each mated with a respective one of said adjacent electrical connectors.

2. The shroud according to claim 1 wherein said electrical module is a memory card.

3. The shroud according to claim 1 wherein said plurality of electrical connectors comprises first and second electrical connectors in stacked relationship.

4. The shroud according to claim 3 wherein said conductive layer is a first plate extending between said two stacked connectors, said first plate being substantially parallel to said circuit board when said shroud is attached thereto and having a bent portion extending from a first edge thereof toward said circuit board.

5. The shroud according to claim 4 including tails extending from said bent portion of said shroud for electrically engaging ground circuitry on said circuit board.

6. The shroud according to claim 5 wherein some of said contacts extend from a second edge of said first plate opposite said first edge, said shroud including an electrically conductive second plate spaced from and substantially parallel to said first plate, wherein others of said contacts extend from a third edge of said second plate, said third edge being vertically above said second edge.

7. The shroud according to claim 6 wherein each of said contacts includes a resilient portion that includes a bend of between about 90 degrees and about 180 degrees with respect to said first and second plates, respectively, so that said contact is positioned between said plate and said circuit board when said shroud is in said engagement with said circuit board.

8. The shroud according to claim 7 wherein said some contacts are arranged to electrically engage an outer conductive surface of a first electrical module when mated with said first connector and said other contacts are arranged to electrically engage an outer conductive surface of a second electrical module when mated with said second connector.

9. A connector array for interconnecting electrical elements of two electrical modules to circuitry on a circuit board comprising:

(a) first and second electrical connectors in stacked relationship, each connector arrange to receive a respective one of said electrical modules and having terminals for electrically engaging said electrical elements thereof, and having leads attached to said terminals for electrically engaging said circuitry on said circuit board; and (b) an electrically conductive shroud having a first plate separating said first and second connectors and said leads of each connector from the leads of the other connector.

10. The connector array according to claim 9 wherein each said electrical module is a memory card having an outer conductive surface.

11. The connector array according to claim 10 wherein said shroud includes a second plate spaced from said first plate, a first plurality of contacts extending from a first edge of said first plate and a second plurality of contacts extending from a second edge of said second plate, said contacts arranged so that when a first of said memory cards is mated with said first connector said first plurality of contacts are in electrical engagement with said outer surface of said first memory card and when a second of said memory cards is mated with said second connector said second plurality of contacts are in electrical engagement with said outer surface of said second memory card.

12. The shroud according to claim 11 wherein each contact, of said first and second pluralities of contacts, includes a resilient portion that includes a bend of between about 90 degrees and about 180 degrees with respect to said first and second plates, respectively, so that said contact is positioned between said respective plate and said circuit board when said first and second connectors are in said engagement with said circuit board.

13. The connector array according to claim 11 wherein said shroud includes tails extending therefrom for electrically engaging ground circuitry on said circuit board.

14. The connector array according to claim 9 wherein each of said first and second connectors includes a housing having outwardly facing walls and an opening in each wall arranged so that said openings of adjacent walls are in alignment when the two connectors are in vertically stacked relationship, and clip members interferingly engaging said openings so that said first and second connectors are secured in said vertically stacked relationship.

* * * * *